US008336166B2

(12) United States Patent
Kim

(10) Patent No.: US 8,336,166 B2
(45) Date of Patent: Dec. 25, 2012

(54) HINGE DAMPER

(75) Inventor: Jae Hong Kim, Seoul (KR)

(73) Assignee: Moonju Hardware Co., Ltd, Incheon (KR)

( * ) Notice: Subject to any disclaimer, the term of this patent is extended or adjusted under 35 U.S.C. 154(b) by 401 days.

(21) Appl. No.: 12/663,208

(22) PCT Filed: Jun. 12, 2007

(86) PCT No.: PCT/KR2007/002792

§ 371 (c)(1),
(2), (4) Date: Dec. 4, 2009

(87) PCT Pub. No.: WO2008/153224

PCT Pub. Date: Dec. 18, 2008

(65) Prior Publication Data

US 2010/0212109 A1 Aug. 26, 2010

(51) Int. Cl.
*E05F 5/02* (2006.01)

(52) U.S. Cl. ..... 16/82; 16/83

(58) Field of Classification Search ..... 16/82–86 A, 16/50, DIG. 9, DIG. 10, DIG. 17, DIG. 21; 188/297

See application file for complete search history.

(56) References Cited

U.S. PATENT DOCUMENTS

| | | | | |
|---|---|---|---|---|
| 4,265,344 | A * | 5/1981 | Taylor | 188/322.17 |
| 5,157,806 | A * | 10/1992 | Wartian | 16/66 |
| 6,315,093 | B1 * | 11/2001 | Miura et al. | 188/282.1 |
| 6,615,450 | B2 * | 9/2003 | Salice | 16/85 |
| 6,957,807 | B2 * | 10/2005 | Zimmer et al. | 267/64.11 |
| 8,104,140 | B2 * | 1/2012 | Bassi | 16/84 |
| 2004/0150143 | A1 * | 8/2004 | Zimmer et al. | 267/64.11 |
| 2004/0231099 | A1 * | 11/2004 | Li | 16/85 |
| 2006/0207057 | A1 * | 9/2006 | Migli | 16/85 |
| 2007/0251052 | A1 * | 11/2007 | Pyo | 16/86 A |
| 2008/0295283 | A1 * | 12/2008 | Tice | 16/84 |
| 2009/0094789 | A1 * | 4/2009 | Bereznai | 16/84 |
| 2009/0119873 | A1 * | 5/2009 | Bassi | 16/84 |
| 2009/0139049 | A1 * | 6/2009 | Bantle et al. | 16/84 |

FOREIGN PATENT DOCUMENTS

| | | | |
|---|---|---|---|
| KR | 20-0402134 | | 11/2005 |
| KR | 10-2006-0061891 | A | 6/2006 |
| WO | WO 2006/059860 | * | 6/2006 |

OTHER PUBLICATIONS

International Search Report of International Application No. PCT/KR2007/002792.

* cited by examiner

*Primary Examiner* — Jeffrey O Brien
(74) *Attorney, Agent, or Firm* — Kile Park Goekjian Reed & McManus PLLC

(57) ABSTRACT

A hinge damper is configured to be adhered to a door hinge of the furniture having a door to attenuate impact and is designed in a small size but to attenuate a large amount of impact. In the hinge damper, first and second seals are formed in an oil seal to prevent air from being introduced. A cross rib is formed on a piston to absorb a larger amount of impact with a small size. The hinge damper can be sized as small as a size of a screw used for fixing the hinge.

5 Claims, 4 Drawing Sheets

【Fig. 1】
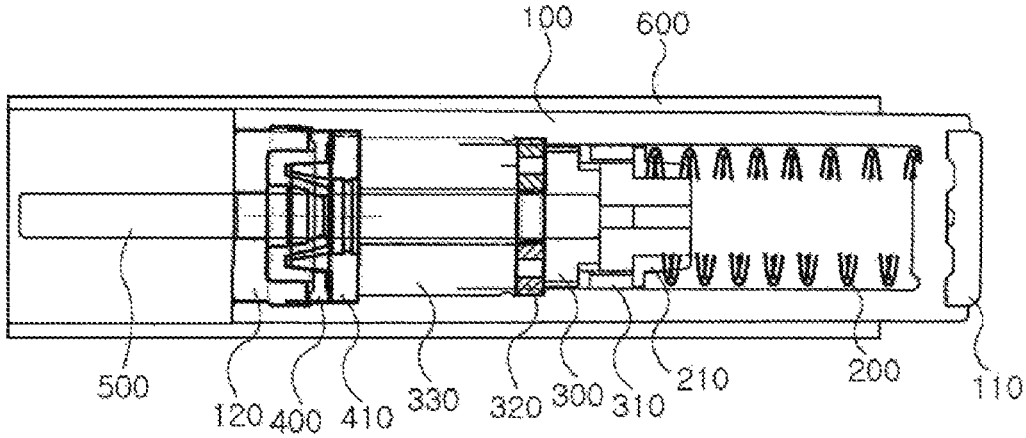
【Fig. 2】
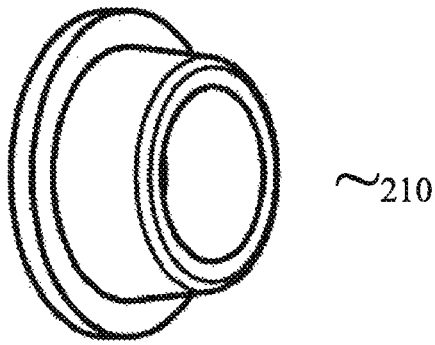

【Fig. 3】
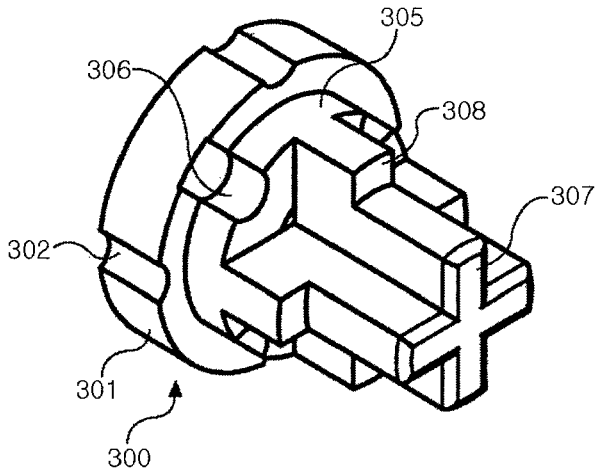
【Fig. 4】
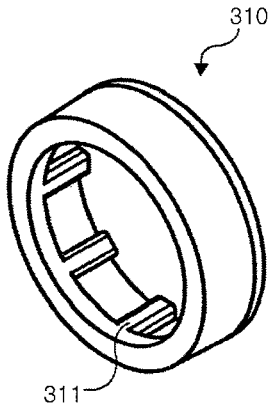
【Fig. 5】
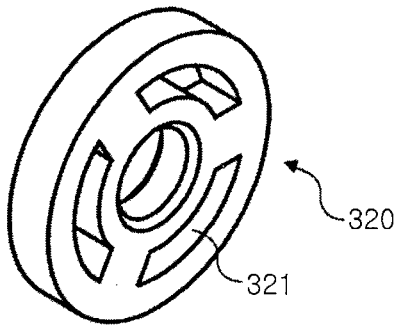

【Fig. 6】
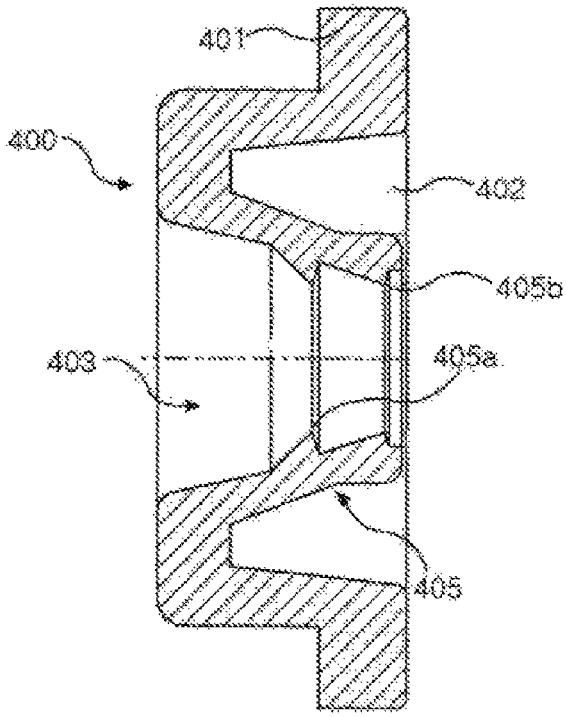
【Fig. 7】
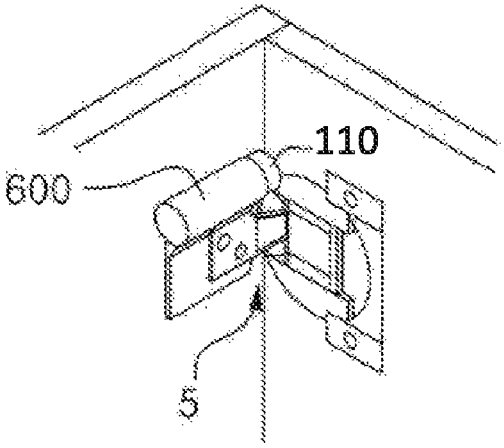

【Fig. 8】 (Prior Art)
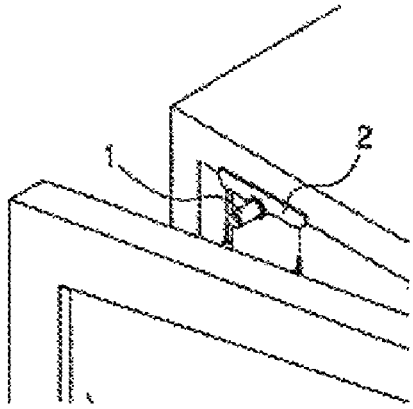
【Fig. 9】 (Prior Art)
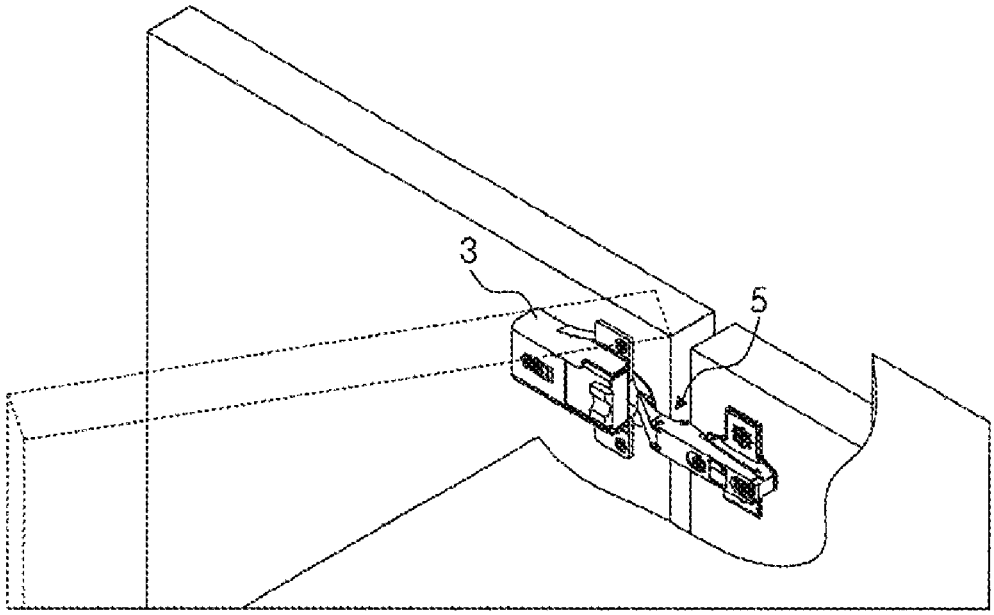

HINGE DAMPER

TECHNICAL FIELD

The present invention relates to a hinge damper and, more particularly, to a hinge damper that is configured to be adhered to a door hinge of the furniture having a door to attenuate impact and is designed in a small size but to attenuate a large amount of impact.

BACKGROUND ART

Generally, a door that can be opened and closed by a spring hinge is installed on the furniture, sink, and the like. When the door is opened and closed, a loud noise is generated by the collision of the door with a frame of the furniture. Particularly, when the children carelessly close the door, the louder noise is generated and the safety-related accident may occur. Further, the furniture may be damaged.

In order to solve the above problems, a furniture damper is installed on the frame of the furniture to attenuate the impact when the door is closed and to prevent the furniture from being damage.

As shown in FIG. 8, a furniture damper of the prior art is a cylindrical damper 1 that is inserted in a hole formed in a location spaced away from a location where a hinge is mounted. Instead of forming the hole, a special holder 2 is mounted to install the furniture damper.

However, since the furniture damper of the prior art protrudes outward, the outer appearance of the furniture is deteriorated. Furthermore, when a side impact is directly applied to the damper 1, the holder and/or the damper 1 may be easily broken.

In order to solve this problem, as shown in FIG. 9, a hinge damper 3 that can be attached to a hinge 5 mounted on a furniture is developed. This hinge damper 3 is disclosed in Korean Utility Model Resistor No. 0402134.

DISCLOSURE

Technical Problem

However, the hinge damper 3 of the prior art requires a special device attached to an upper end of the hinge 5 and increases a size of the hinge 5. Therefore, the hinge damper 3 is limited in its installation. In addition, the outer appearance of the hinge damper 3 is not good.

Technical Solution

Therefore, the present invention has been made in an effort to solve the problems of the prior arts and developed with the following objects.

(1) An object of the present invention provides a hinge damper that is designed in a small size.

(2) Another object of the present invention provides a hinge damper that does not cause a substantial increase in a size of the hinge.

(3) Still another object of the present invention provides a hinge damper that is sized to be hardly exposed to an external side, thereby improving an outer appearance.

To achieve the objects, the present invention provides a hinge damper having a housing filled with oil, a check valve controlling the flow of the oil, a rod connected to the check valve, and a spring returning the check valve. The hinge damper includes a cylindrical housing (100) having an opened end and a closed end; a bumper (110) is attached at an outer portion of the housing; a spring (200) inserted in the housing (100); a spring holder (210) for holding the spring at a side of the spring; a piston (300) disposed at a side of the spring holder (210) and provided with a fluid passage; a backup ring (310) formed between the spring holder (210) and the piston (300); a rod (500) fixed to the piston (300) and extending out of the housing (100); a stopper (320) formed at a side of the piston (300) and provided with an opening hole; a sponge formed at a side of the stopper (320); a seal support formed at a side of the sponge; and a cover (120) formed at a side of the oil seal (400) and closing the opened end of the housing (100).

Advantageous Effects

According to a hinge damper of the present invention, the following effects can be obtained.

(1) The hinge damper can be small-sized while attenuating impact the present invention has been made.

(2) The hinge damper does not affect on the size of the hinge.

(3) Since the hinge damper can be identically sized to a screw used for fixing the hinge, it is not exposed to an external side.

BRIEF DESCRIPTION OF DRAWINGS

FIG. 1 is a sectional view of a hinge damper according to an exemplary embodiment of the present invention.

FIG. 2 is a sectional view of a spring holder of a hinge damper according to an exemplary embodiment of the present invention.

FIG. 3 is a perspective view of a piston of a hinge damper according to an exemplary embodiment of the present invention.

FIG. 4 is a perspective view of a backup ring of a hinge damper according to an exemplary embodiment of the present invention.

FIG. 5 is a perspective view of a stopper of a hinge damper according to an exemplary embodiment of the present invention.

FIG. 6 is a sectional view of an oil seal of a hinge damper according to an exemplary embodiment of the present invention.

FIG. 7 is a view illustrating the use of a hinge damper according to an exemplary embodiment of the present invention.

FIG. 8 is a view of a door damper of the prior art.

FIG. 9 is a view of a hinge damper of the prior art.

BEST MODE FOR CARRYING OUT THE INVENTION

Reference will now be made in detail to the embodiments of the present disclosure, examples of which are illustrated in the accompanying drawings.

Referring to FIGS. 1 through 7, a hinge damper includes a housing filled with oil, a check valve controlling the flow of the oil, a rod connected to the check valve, and a spring returning the check valve. In more detail, the hinge damper includes a cylindrical housing 100 having an opened end and an closed end, on outer portion of which a bumper 110 is attached; a spring 200 inserted in the housing 100; a spring holder 210 for holding the spring at a side of the spring; a piston 300 disposed at a side of the spring holder 210 and provided with a fluid passage; a backup ring 310 formed between the spring holder 210 and the piston 300; a rod 500 fixed to the piston 300 and extending out of the housing 100; a stopper 320 formed at a side of the piston 300 and provided with an opening hole 321; a sponge 330 formed at a side of the stopper 320, a seal support formed at a side of the sponge 330; and a cover 120 formed at a side of the oil seal 400 and closing the opened end of the housing 100.

An outer circumference of the housing 100 is designed to be inserted in a damper case 600 depicted in FIG. 7. A protrusion is formed on a side of the outer circumference of the housing 100.

The bumper 110 formed on a front portion of the housing 100 is formed of an elastic material such as rubber.

The spring returns the housing 100 frontward when the rod 500 is supported in the damper case 600. The spring 200 is fixed by the spring holder 210. That is, the spring holder 210 is provided at the center with the hole and has a spring holding portion having an outer circumference inserted in an end of the spring 200 and a flat portion having a diameter greater than that of the spring and contacting an inner wall of the housing 100.

The piston 300 includes a lower disk 301 having an outer circumference closely contacting an inner wall of the housing 100 and provided with a plurality of lower fluid passages, an upper disk 305 disposed at a side of the lower disk 301, having a diameter less than that of the lower disk 301, and provided with a plurality of upper fluid passages 306, and a cross rib 307 formed on an upper end of the upper disk 305 and provided with a rib step 308.

The number of the lower fluid passages 302 is about 3-8. By controlling the number of the lower fluid passages 302, the damper returning speed can be controlled.

The number of the upper fluid passages 306 is about half of the number of the lower fluid passages so that, when the impact is applied, the lower fluid passages 302 are closed by the backup ring 310 and while the upper fluid passages 306 are opened to allow the oil to flow.

The backup ring 310 is provided at the center with a hole and at an inner surface with a plurality of protruding ribs 311. The backup ring 310 is formed of an elastic material.

By increasing the number of the protruding ribs 311, the backup ring 310 can endure a larger amount of impact. The number of the protruding ribs 311 is preferably 8.

The backup ring 310 is formed between a side of the spring holder 210 and the lower disk 301 of the piston 300.

When the rod 500 is applied with impact by the door 10, the piston 300 is momentarily pushed to a side and the backup ring 310 that is stopped by inertia force expands by the oil therein, thereby closing the lower fluid passages 302 of the piston 300.

The stopper 320 is provided at a center with a hole through which the rod 500 passes. The stopper 320 is further provided with a plurality of opening holes 321 spaced apart from each other along the hole.

The seal support 410 and the oil seal 400 are fixed by an inner step of the housing 100 and the cover 120. The seal support 410 is provided at a center with a hole and inserted in a side of the oil seal 400.

A seal flat portion 401 that is a flat step is formed on the outer circumference of the oil seal 400 and is provided at a center with a rod insertion hole 403. An inclined seal operation portion 405 extends from the oil seal 400 while defining a space portion 402.

An outer circumference of the cover 120 coupled to an upper end of the seal flat portion 401.

The rod 500 is inserted in the rod insertion hole 403 so that the oil does not leak by the seal operation portion 405.

First and second seals 405*a* and 406*b* that protrude and are inclined are formed on the inner circumference of the seal operation portion 405. The first and second seals 405*a* and 406*b* are spaced apart from each other.

The first seal 405*a* is formed to prevent external air from being introduced when the rod 500 is inserted.

The invention claimed is:

1. A hinge damper having a housing filled with oil, a check valve controlling a flow of the oil, a rod connected to the check valve, and a spring returning the check valve, the hinge damper comprising:

a cylindrical housing having an opened end and a closed end;

a bumper attached at an outer portion of the housing;

a spring inserted in the housing;

a spring holder for holding the spring, the spring holder being disposed at a side of the spring;

a piston disposed at a side of the spring holder and provided with a fluid passage;

a backup ring formed between the spring holder and the piston;

a rod fixed to the piston and extending out of the housing;

a stopper formed at a side of the piston and provided with an opening hole;

a sponge formed at a side of the stopper;

a seal support formed at a side of the sponge; and a cover formed at a side of an oil seal and closing the opened end of the housing, wherein a seal flat portion is formed on an outer circumference of the oil seal and is provided at a center with a rod insertion hole, an inclined seal operation portion extending from the oil seal while defining a space portion.

2. The hinge damper of claim 1, wherein the piston includes:

a lower disk having an outer circumference closely contacting an inner wall of the housing and provided with a plurality of lower fluid passages;

an upper disk disposed at a side of the lower disk, having a diameter less than that of the lower disk, and provided with a plurality of upper fluid passages; and a cross rib formed on an upper end of the upper disk and provided with a rib step.

3. The hinge damper of claim 2, wherein a number of the lower fluid passages is in a range of 3-8, and a number of the upper fluid passages is less than the number of the lower fluid passages.

4. The hinge damper of claim 1, wherein the backup ring is provided at a center with a hole and at an inner surface with a plurality of protruding ribs.

5. The hinge damper of claim 1, wherein the seal operation portion includes first and second seals that are formed on an inner circumference of the seal operation portion, the first and second seals being identical to each other and spaced apart from each other.

* * * * *